US012442208B2

(12) United States Patent
Crookston, IV

(10) Patent No.: US 12,442,208 B2
(45) Date of Patent: Oct. 14, 2025

(54) ROOF LEAK REMEDIATION LEAVING IN PLACE SATURATED MATERIAL

(71) Applicant: Liquidry Roof Systems, LLC, Akron, OH (US)

(72) Inventor: Anthony Joseph Crookston, IV, Akron, OH (US)

(73) Assignee: Liquidry Roof Systems, LLC, Akron, OH (US)

( * ) Notice: Subject to any disclaimer, the term of this patent is extended or adjusted under 35 U.S.C. 154(b) by 224 days.

(21) Appl. No.: 18/334,554

(22) Filed: Jun. 14, 2023

(65) Prior Publication Data

US 2024/0417988 A1 Dec. 19, 2024

(51) Int. Cl.
*E04G 23/02* (2006.01)
*E04D 13/17* (2006.01)

(52) U.S. Cl.
CPC ..... *E04G 23/0281* (2013.01); *E04D 13/17* (2013.01)

(58) Field of Classification Search
CPC ... E04G 23/0281; E04D 13/17; E04D 13/006; E04B 1/70; E04B 1/7069; F24F 7/02
See application file for complete search history.

(56) References Cited

U.S. PATENT DOCUMENTS 4,490,952 A * 1/1985 Winston ..... E04D 13/17 52/302.3
4,534,119 A * 8/1985 Glicksman ..... E04D 13/17 34/95
4,608,792 A 9/1986 Gerber
4,850,166 A * 7/1989 Taylor ..... E04D 13/17 52/302.3
5,069,950 A * 12/1991 Crookston, Sr. ..... E04D 13/172 52/302.1
5,473,847 A * 12/1995 Crookston ..... E04C 2/205 52/95
5,950,326 A * 9/1999 Scott ..... E04D 13/17 34/310
9,556,617 B2 * 1/2017 Preston ..... E04D 13/172
10,094,120 B2 * 10/2018 Preston ..... E04D 13/172

OTHER PUBLICATIONS

Burke Industries; Vac-Q-Roof Installation Specification; 2023, 2 pages.

* cited by examiner

*Primary Examiner* — Adriana Figueroa
(74) *Attorney, Agent, or Firm* — Taft Stettinius & Hollister LLP

(57) ABSTRACT

Roof-on-roof methods of leak remediation leave in place existing roof membrane material and saturated material (e.g., insulation). An example leak-remediated roof includes a layer of saturated insulation over a roof deck. A membrane over the insulation has one or more failures that have permitted the insulation to become saturated. A grid of cuts is made through the membrane and the insulation down to the roof deck. A mechanical vent is placed over a cut of the grid A strip of mesh vent is installed over a cut of the grid. The strip of mesh vent is coupled in airflow communication with an underside inlet or a lateral inlet of the mechanical vent. A non-liquid sealer, such as tape or covering membrane, seals over the strip of mesh vent. A liquid roof coating is applied over an entire surface of a treated portion of the roof, including over the non-liquid sealer.

20 Claims, 16 Drawing Sheets

CUT GRID DOWN TO DECK THROUGH EXISTING MEMBRANE AND SATURATED MATERIAL

INSTALL MECHANICAL VENTS OVER CUTS (E.G., AT CUT INTERSECTIONS)

INSTALL STRIPS OF MESH VENT OVER CUTS

SEAL OVER MESH VENTS WITH NON-LIQUID SEALER (E.G., TAPE OR COVERING MEMBRANE)

APPLY LIQUID ROOF COATING OVER ENTIRE SURFACE OF TREATED ROOF PORTION

ROOF LEAK REMEDIATION LEAVING IN PLACE SATURATED MATERIAL

TECHNICAL FIELD

This description relates generally to roofing, and more particularly to roof leak remediation leaving in place saturated material.

BACKGROUND

Roofs of large commercial buildings, such as office buildings, warehouses, and factories, are often flat roofs that include a membrane layer over an insulation layer. Water saturation of roof material, such as insulation, is a common cause of roof leaks. As examples, saturation can occur following back-out of a screw, nail, or other fastener; penetrated or failing flashing; worn, weathered, or wind-blown coatings; roof membrane puncture; seam de-adhesion; and/or ponding of water in low roof areas. Conventional methods of addressing leaks involve identifying and replacing saturated roofing material. Methods used to identify saturated regions include thermal imaging and the taking of core samples. Replacement of saturated roofing material can be labor-intensive, time-consuming, and expensive.

SUMMARY

An example method of roof leak remediation includes cutting a grid of cuts through a membrane on a roof, through saturated material of the roof under the membrane, and to a deck of the roof. A mechanical vent is installed over a cut of the grid. A strips of mesh vent is installed over a cut of the grid, the strip of mesh vent in airflow communication with an inlet of the mechanical vent. The strip of mesh vent is sealed over with non-liquid sealer. A liquid roof coating is applied over a treated portion of the roof, including over the non-liquid sealer.

Another example method of roof leak remediation includes cutting a grid of cuts through a membrane above a roof deck and through saturated material of the roof under the membrane. Strips of mesh vent are installed over the cuts of the grid. Mechanical vents are installed over cuts of the grid. The strips of mesh vent are sealed over with non-liquid sealer.

An example leak-remediated roof includes a solid roof deck and a layer of saturated material over the roof deck. A membrane of the roof, over the layer of saturated material, has one or more failures that have allowed liquid to engage the saturated material. The roof further includes a grid of cuts extending through the membrane and the saturated material down to the roof deck. The roof further includes a mechanical vent over at least one cut of the grid. The roof further includes a strip of mesh vent over at least one cut of the grid. The strip of mesh vent is in airflow communication with an underside inlet or a lateral inlet of the mechanical vent. The roof further includes a non-liquid sealer that seals over the strip of mesh vent. The roof further includes a liquid applied roof coating that coats over a treated portion of the roof including the non-liquid sealer.

DETAILED DESCRIPTION

Roof repair methods and roofs described herein provide solutions to repair failed roofs or roof portions without removing existing roof membranes or underlying saturated material. Because the described methods do not require removal of the saturated material, they can be less costly than conventional methods that involve removal of roof membranes and saturated material. The methods described herein can be described as "roof-on-roof" or "roof-over-roof" in that they involve the installation of roofing material over existing failed roof membrane material without substantially removing the failed roof membrane material.

Examples of the methods are now described with regard to FIGS. 1A through 1F and 2A through 2F. FIGS. 1A through 1F show an example repair method sequence of roof cross-sections indicating layers of material and devices to illustrate structure and methods of roof-on-roof repair. FIGS. 2A through 2F respectively correspond to FIGS. 1A through 1F and show an example repair method sequence using a series of orthographic projection diagrams. The drawings are diagrammatic in nature and are not necessarily to scale. For clarity, layers may be shown as thicker or thinner in proportion to other layers and devices than they would be in practice. Described distance dimensions likewise are not necessarily illustrated to scale.

Figure 1A:
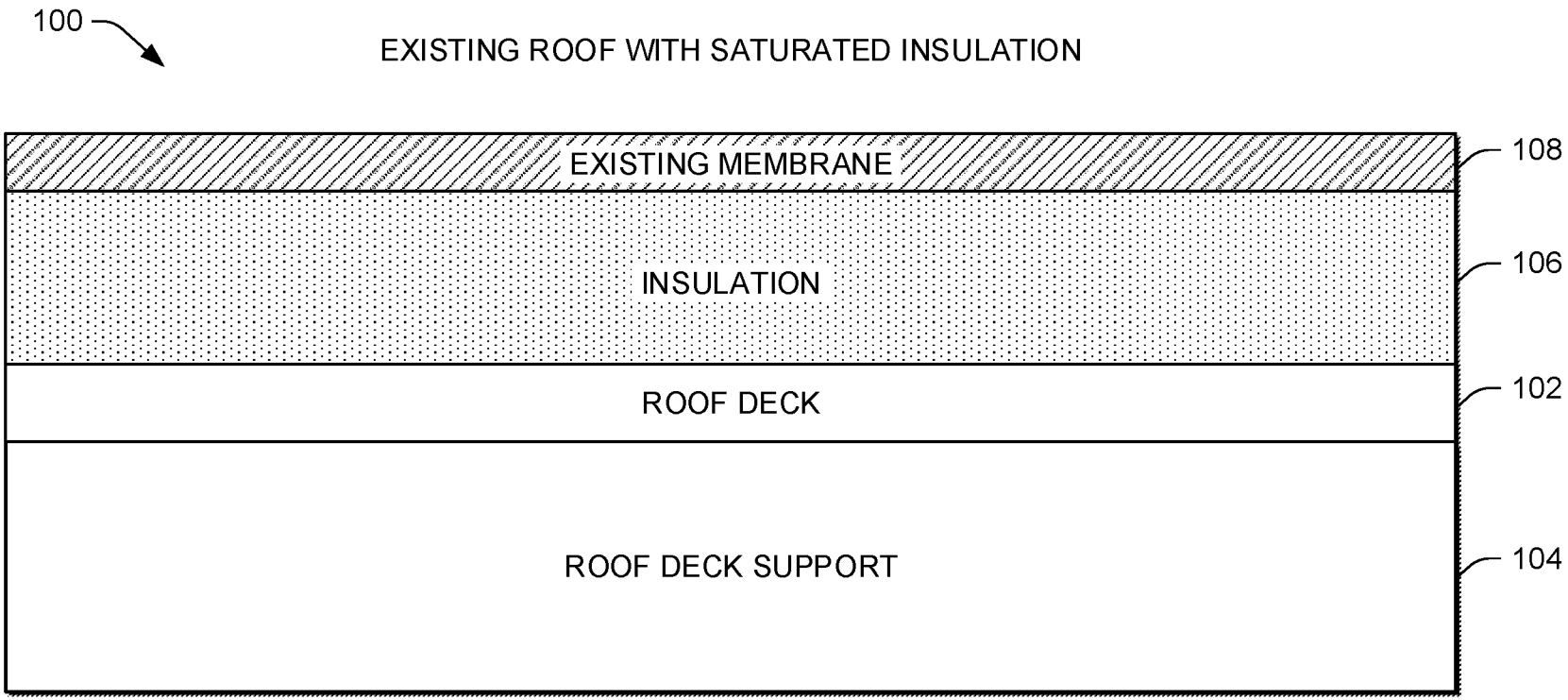
FIGS. 1A through 1G are cross-sectional diagrams showing example roofing layers illustrating roof-on-roof repair methods and repaired roofs.
Figure 2A:
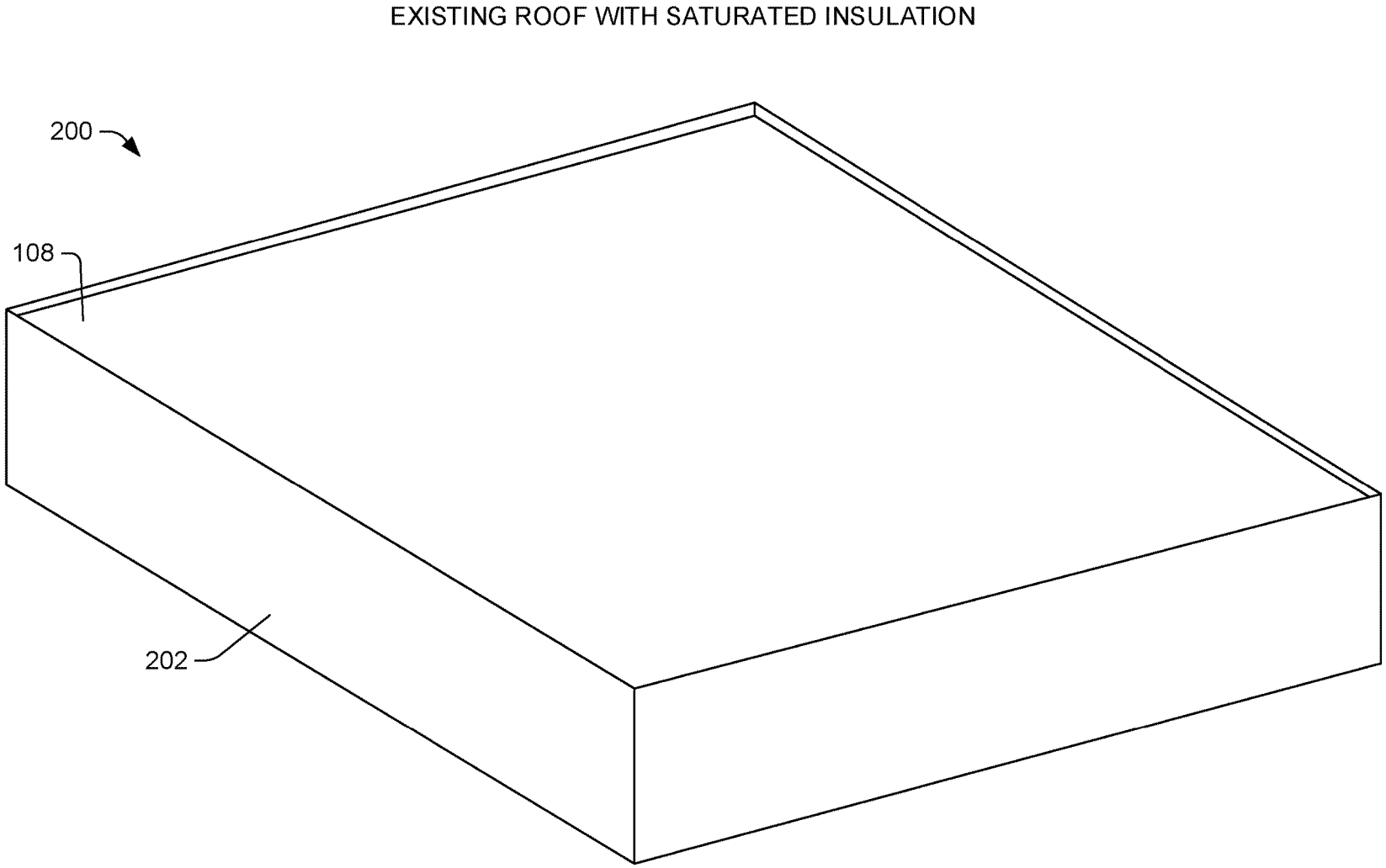
FIGS. 2A through 2G are orthographic projection diagrams illustrating example roof-on-roof repair methods and repaired roofs.
Figure 2B:
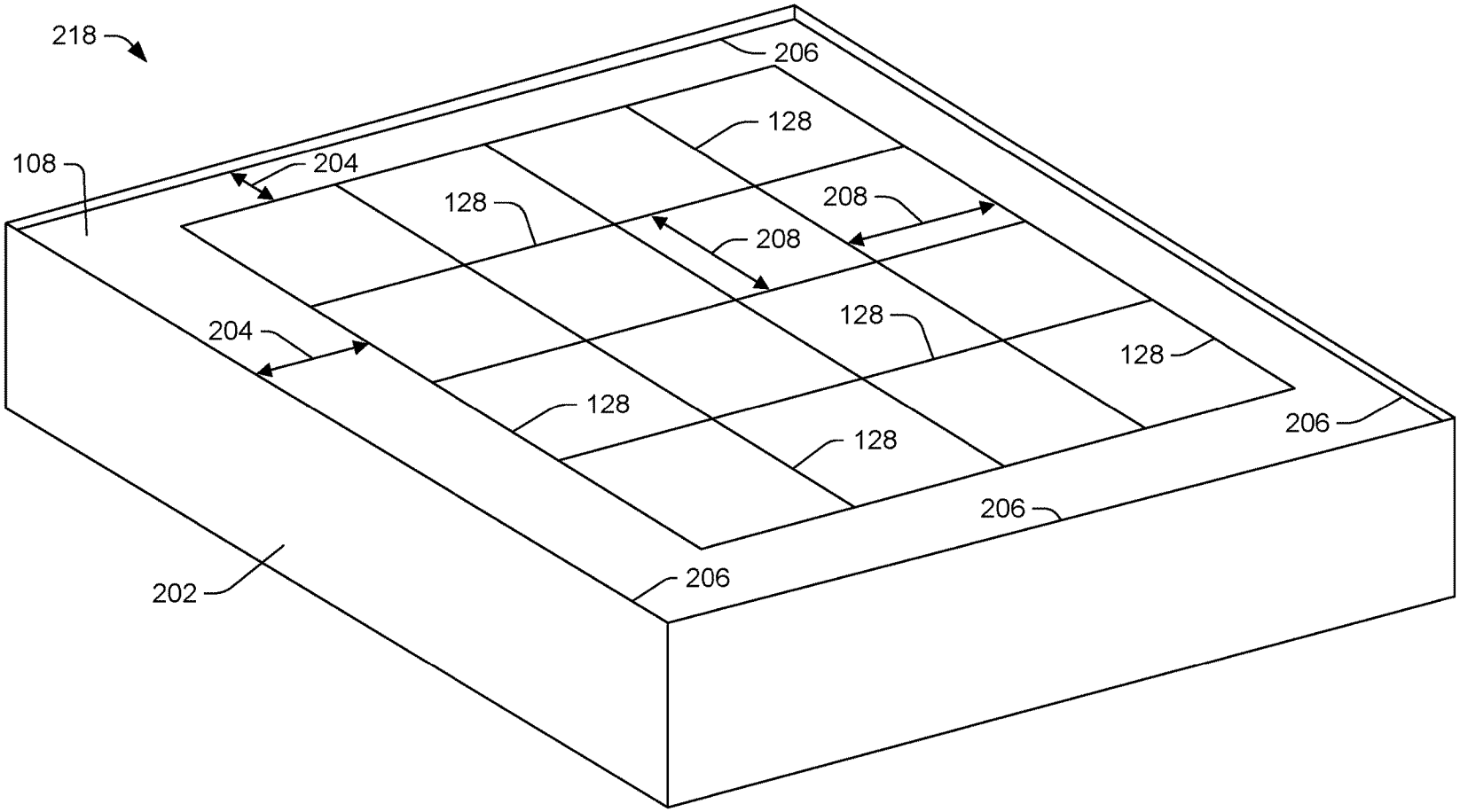
Figure 2C:
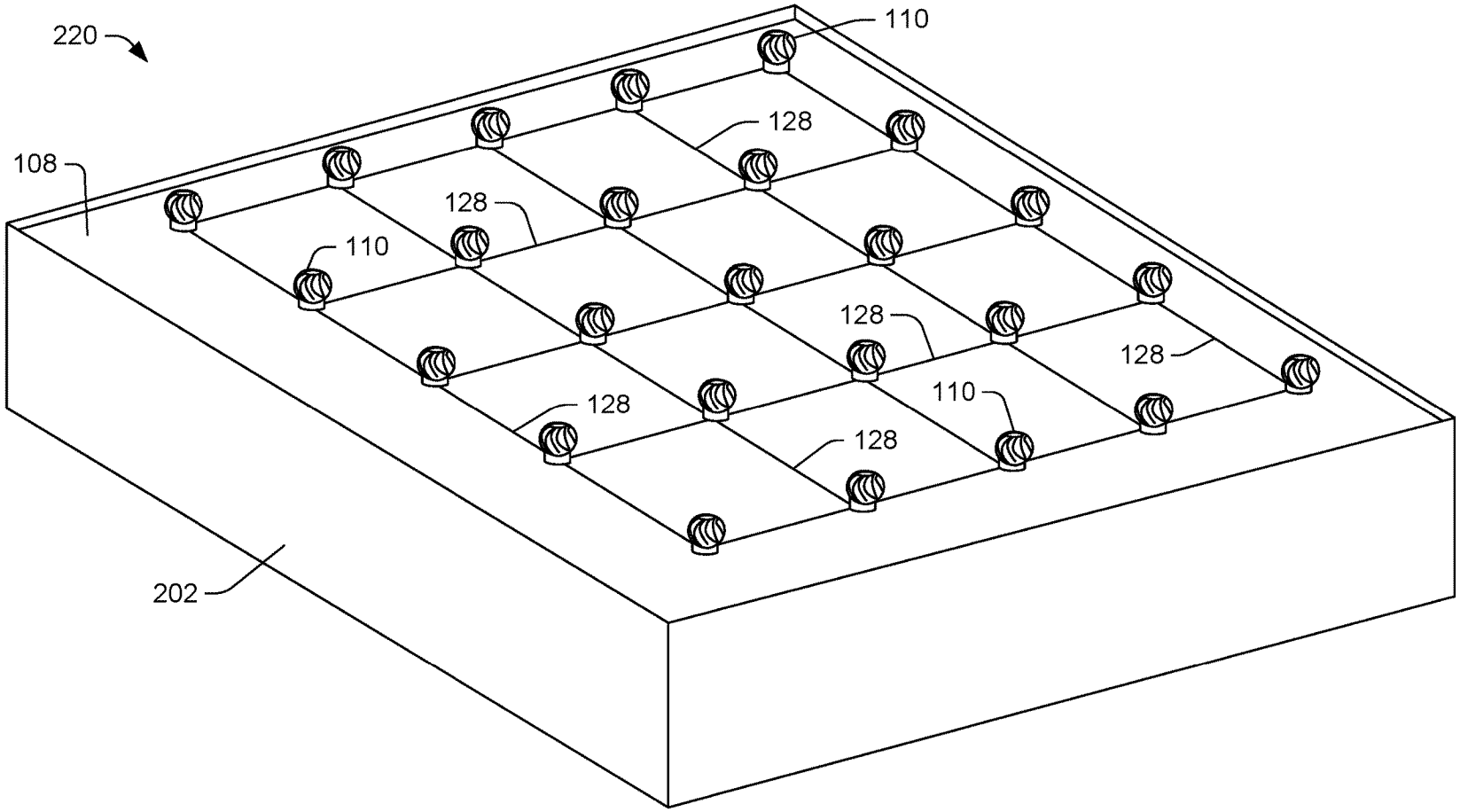
Figure 2D:
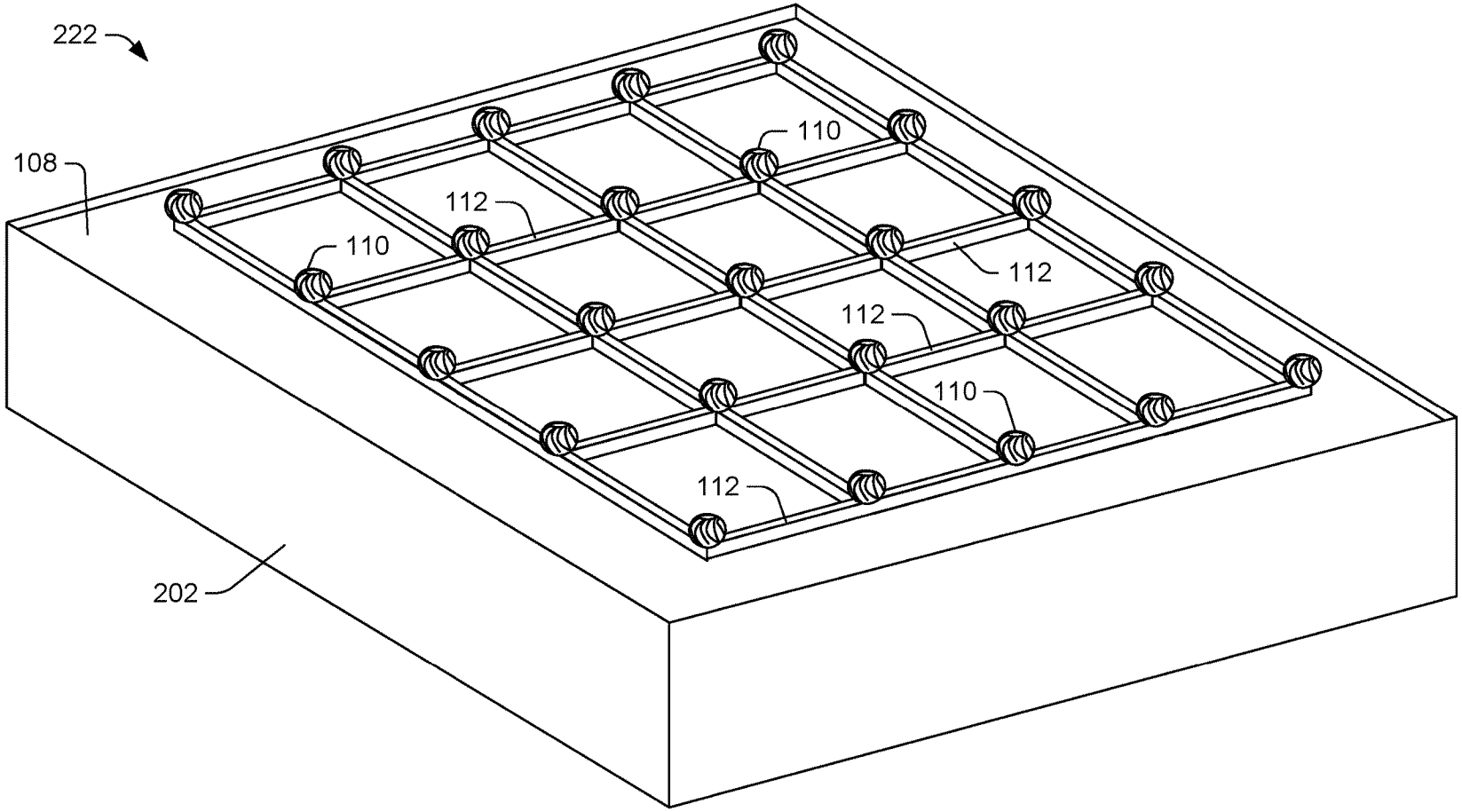

FIG. 1A shows a cross-section of an example portion 100 of an existing roof in need of repair due to saturated roofing material. A roof deck 102 is installed over a roof deck support 104. The roof deck support 104 can comprise any substantially horizontal supports, such as girders, beams, or joists. Decking material of the roof deck 102 can comprise any solid material such as wood, steel, or concrete, but is not a non-solid or porous material such as acoustic steel decking, which has holes in it, or TECTUM decking, which comprises filamentary fibers held together with a binder. A layer of insulation 106 covers the roof deck 102. The material of the insulation 106 can be, as examples, mineral wool, polyisocyanurate, fiberglass, spray-on foam, extruded polystyrene, or expanded polystyrene. The insulation 106 is, in turn, covered by a membrane 108 intended to provide a watertight seal. The membrane 108 may be single ply or can comprise multiple layers. Examples of membrane materials include thermoplastic polyolefin (TPO), ethylene propylene diene monomer (EPDM) (also known as "rubber roof"), polyvinyl chloride (PVC), and asphalt-coated with fiberglass mat. The seal of the membrane 106 may fail such that the insulation 106 has become saturated with water, which has the potential to cause leaks through the deck 102. FIG. 2A shows a corresponding orthographic projection view 200 of a building 202 with a roof. As illustrated, only the top layer, the existing membrane 108, is visible in view 200 of FIG. 2A.

Prior to the repair steps described below with regard to FIGS. 1B through 1F and 2B through 2F, the portion of the roof that is to be treated can be cleaned and primed in accordance with the conventional practices associated with a liquid applied roof coating system of choice. Some liquid applied roof coating systems require between about 36 hours and about 48 hours for a primer to cure, depending on weather conditions. Other liquid applied roof coating systems require between about 96 hours and about 140 hours to cure, depending on weather conditions. Still other liquid applied roof coating systems may require less or more time for primer cure, before continuing with the methods as described below. "Liquid applied roof coating system," as used herein, encompasses a liquid-applied coating along with primer, flashing cements, and any other elements understood in the art as being required to make the liquid applied roof coating effective. Any of the different liquid applied roof coating systems may be selected according to the conditions of a particular roof leak remediation job, the desired roof lifespan, job budget, allocated installation time, and/or preferences of the roofer or property owner.

Figure 1B:
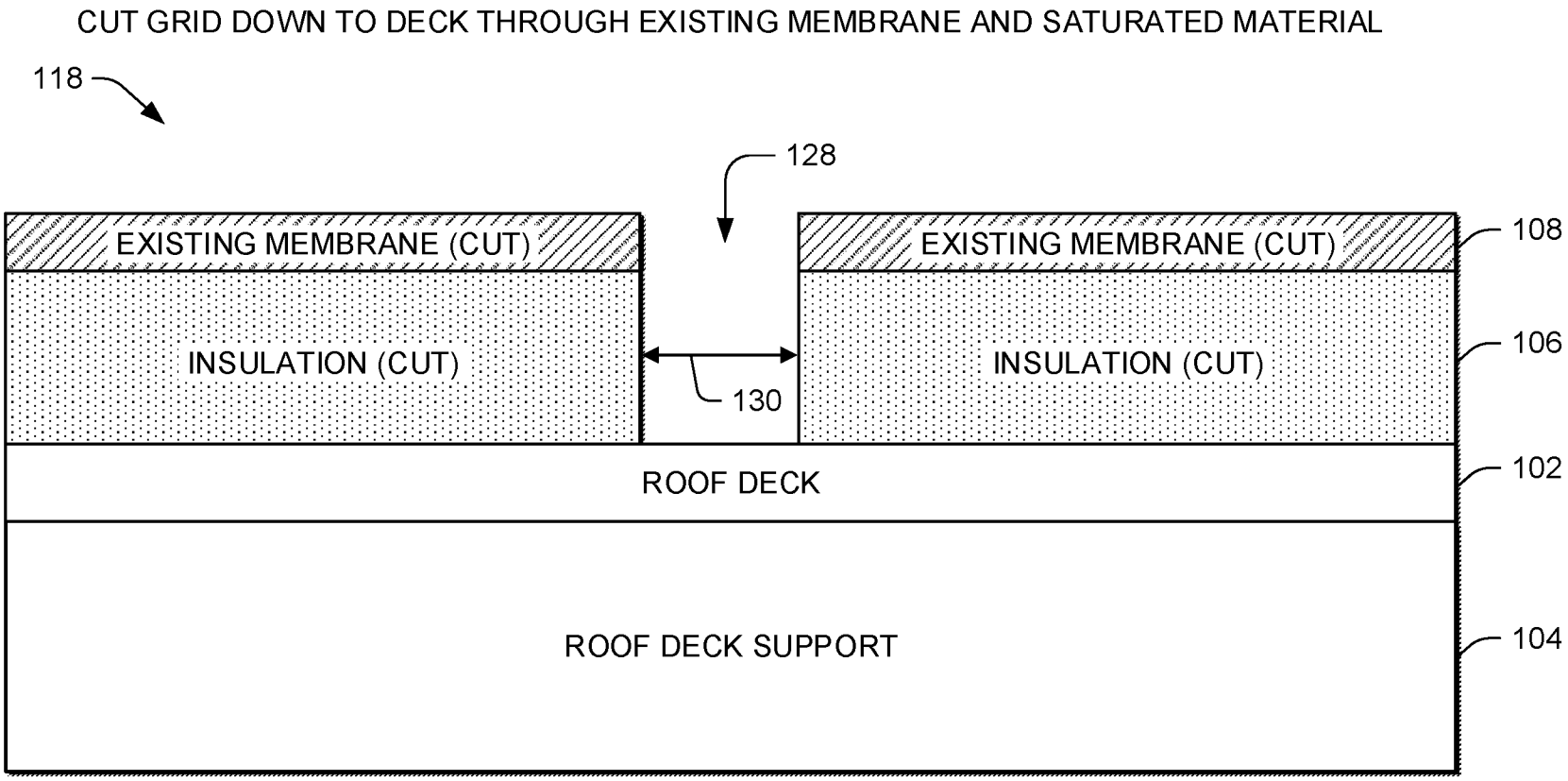

The cross-section of FIG. 1B shows a view 118 of the cross-section 100 of FIG. 1A after a cut 128 has been made through the existing membrane 108 and the insulation 106 down to, but not through, the deck 102. The cut 128 can be made, for example, using a roof cutter blade or rotary saw. The width 130 of the cut 128 is between about 1/16th of an inch and about 1.5 inches, e.g., between about 1/8th of an inch and about 1 inch. As shown in orthographic view 218 of FIG. 2B, a grid of such cuts 128 can be made over a portion or portions of the roof determined to have saturated material, such as a saturated insulation layer. The cuts of the grid can be substantially contiguous. In some examples (not shown), the cuts can be discontinuous, and/or several separate grids of cuts can be made. The term "grid of cuts" as used herein does not mean merely an array or set of non-contiguous core cuts. In some examples, the cuts are linear cuts. In some examples, the cuts are contoured cuts. In some examples, the cuts are trenches.

The determination of which portion or portions of the roof should be provided with the repair methods described herein, which include the cutting of the grid of cuts 128, can be made using, as examples, one or more of thermal imaging (e.g., active infrared) or the taking of core samples. Core samples can be taken using a hand tool in such a manner than prevents cutting through the deck 102. Thermal imaging and/or core samples can reveal saturated material that conventionally would need to be removed and replaced prior to installation of new roofing material. In the methods described herein, the saturated material (e.g., insulation 106) and the overlying membrane 108 can advantageously be left largely in place. Cuts 128 are made to provide airflow pathways. The flow of air through the pathways provided by cuts 128, aided by a negative pressure developed between the solid roof deck 102 and overlying layers described below, can subsequently dry the saturated material, ameliorating and ultimately eliminating leaks in the treated roof portion(s).

In some examples, the grid of cuts 128 can comprise a sets of parallel and perpendicular cuts 128. Although a rectangular grid of cuts is shown in the example of FIGS. 2A through 2F, other examples can use a circular or contoured grid. The shape of the grid can depend on, and can be conformed to, the shape of the roof plan. The grid of cuts 128 may be made starting a minimum distance 204 away from the outer perimeter 206 of the roof. As an example, the minimum distance 204 can be 5 feet. To permit an effective amount of the negative pressure to be developed, the cuts 128 may be made a maximum distance 208 away from other substantially parallel cuts 128. As an example, the maximum distance 208 can be 10 feet.

Figure 1C:
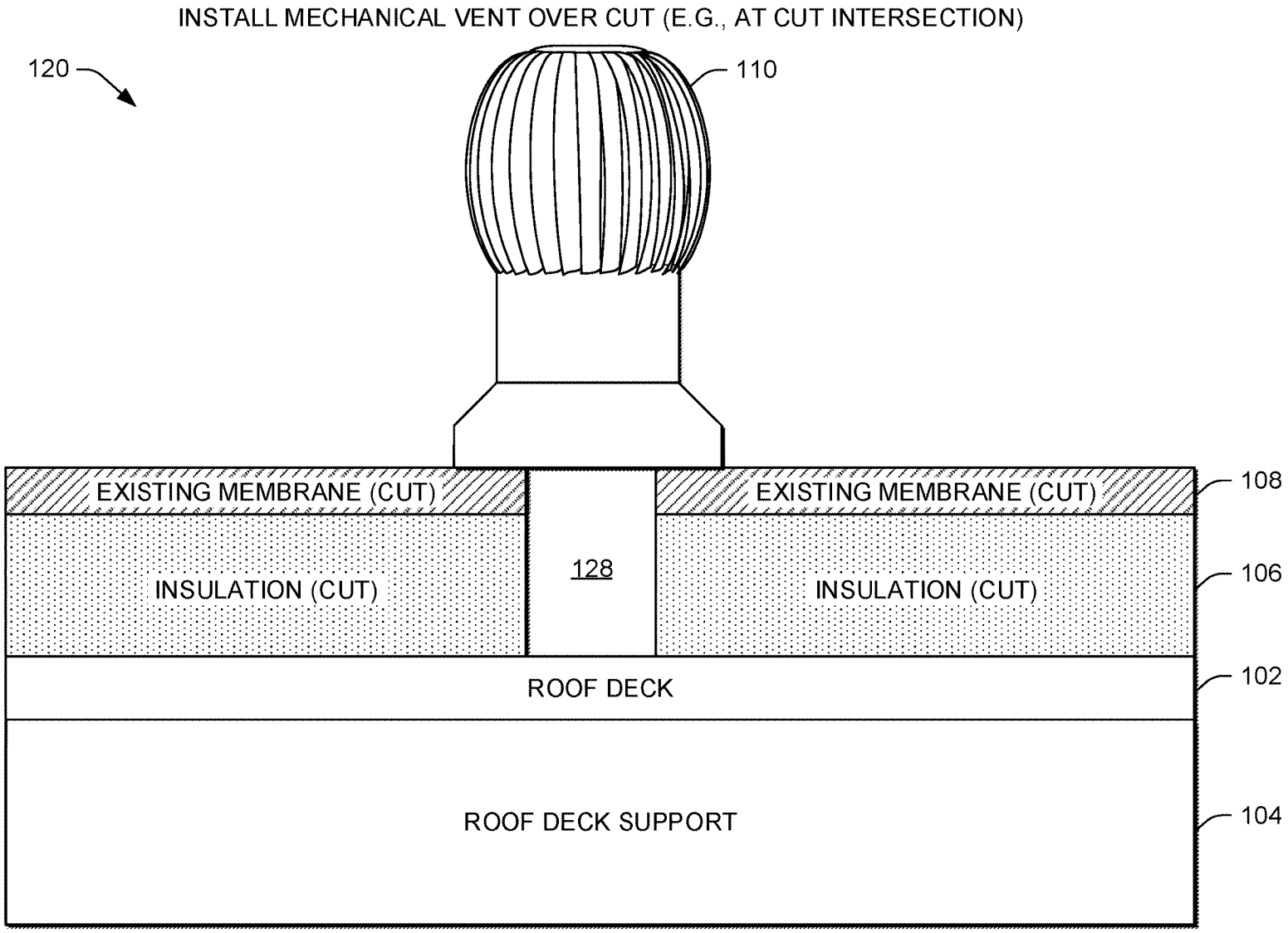

The cross-section of FIG. 1C shows a view 120 of the cross-section 100 of FIG. 1A after a mechanical vent 110 has been installed over the cut 128. In some examples, as shown in FIG. 1C, the mechanical vent 110 is installed directly over, and is secured into or onto, the existing membrane. In some examples, as shown in view 220 of corresponding FIG. 2C, one or more of the mechanical vents 110 are installed at intersections of the cuts 128 in the cut grid. When a mechanical vent 110 is installed over and at the location of a grid cut intersection, a core cut can be made at the location of the grid cut intersection prior to installation of the mechanical vent 110 to improve airflow. Mechanical vent 110 can be any type of vent capable of venting out so as to create the negative pressure between the roof deck 102 and an overlying layer described below. Examples of suitable mechanical vents include wind-driven turbine vents, electrically driven vents, and solar-powered electrically driven vents. In some circumstances, wind-driven turbine vents can have advantages of simplicity, cost-effectiveness, and longer life.

Figure 1D:
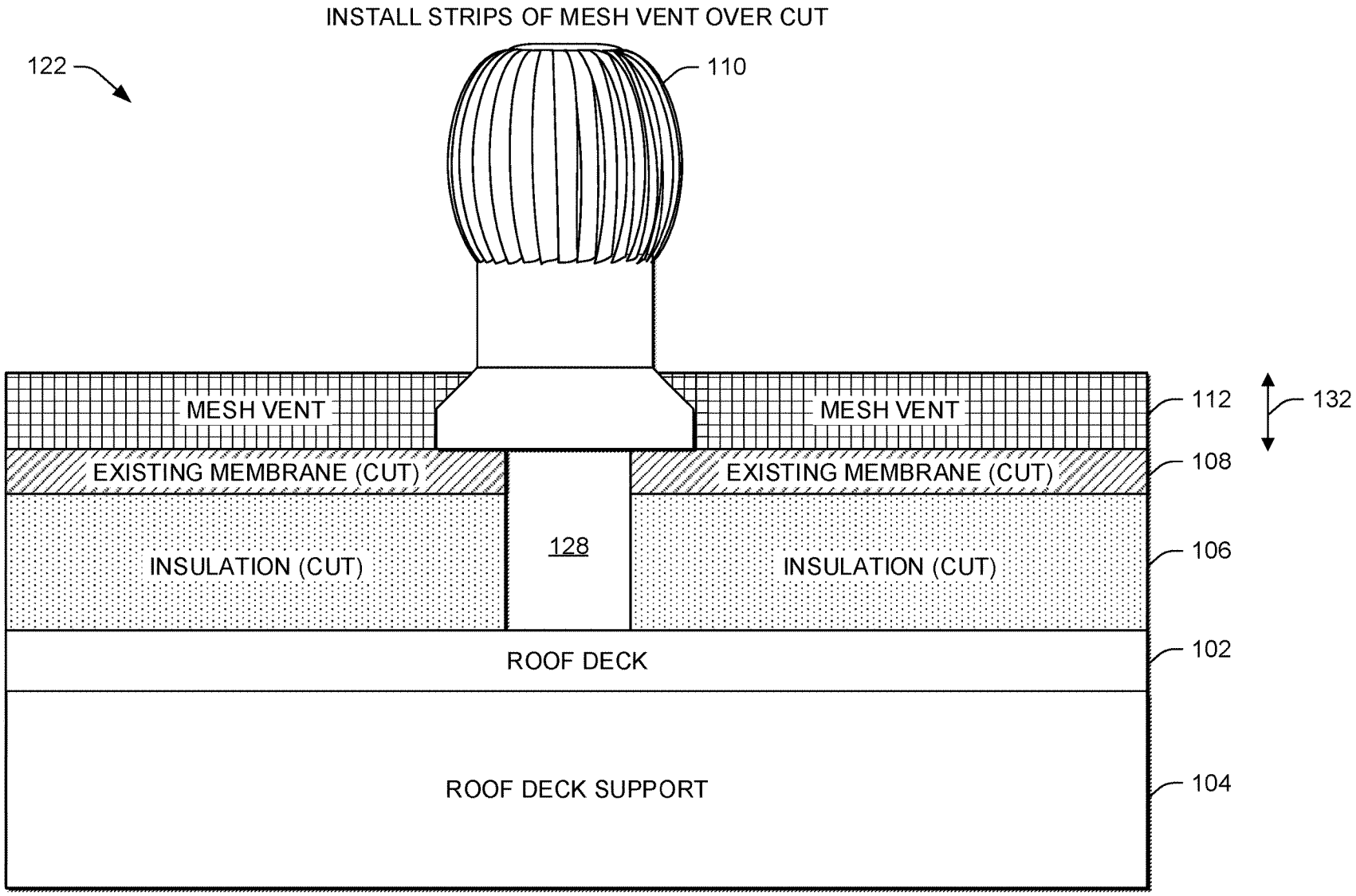

The cross-section of FIG. 1D shows a view 122 of the cross-section 100 of FIG. 1A after a mesh vent 112 has been installed over the existing membrane 108 at the location of a cut 128. The mesh vent 112 is coupled to one or more inlets of mechanical vent 110 to permit airflow through the mesh vent 112 and up and out through the mechanical vent 110. As shown in view 222 of corresponding FIG. 2D, strips of the mesh vent 112 need only cover over the cuts 128, and need not cover over the entire surface of the treated portion of the roof. The material of the mesh vent 112 can be any suitable mesh vent material, such as a metal mesh structure, that is capable of providing horizontal airflow in the lengthwise direction of the strips of mesh vent, that is, in the lengthwise direction of the underlying cut 128. Examples of suitable mesh vent materials include GAF COBRA ridge vent (or "exhaust vent for roof ridge"), which is commonly sold in rolls of material that measure 20 feet long by 10.5 inches wide when unrolled into strips. Unsuitable mesh vent materials include those engineered to permit airflow only across the width of the mesh vent strips, from one side of the strip width to the other side of the strip width, and that do not permit airflow across the length dimension of the mesh vent strip. An example of an unsuitable material that would not work as mesh vent 122 is COR-A-VENT V300 ridge vent. Strips of mesh vent 112 can be, for example, between about 5 inches and about twelve inches in width. Thus, the entire width of a 10.5-inch-wide roll of COBRA ridge vent can be used in one piece, or a roll can be cut in half into two strips of width about equal to or greater than 5 inches before installation of each strip. In practice, the mesh vent 112 may have a height (vertical thickness) dimension 132 of between about 0.5 inches and about 2 inches, e.g., about 1 inch.

Figure 1E:
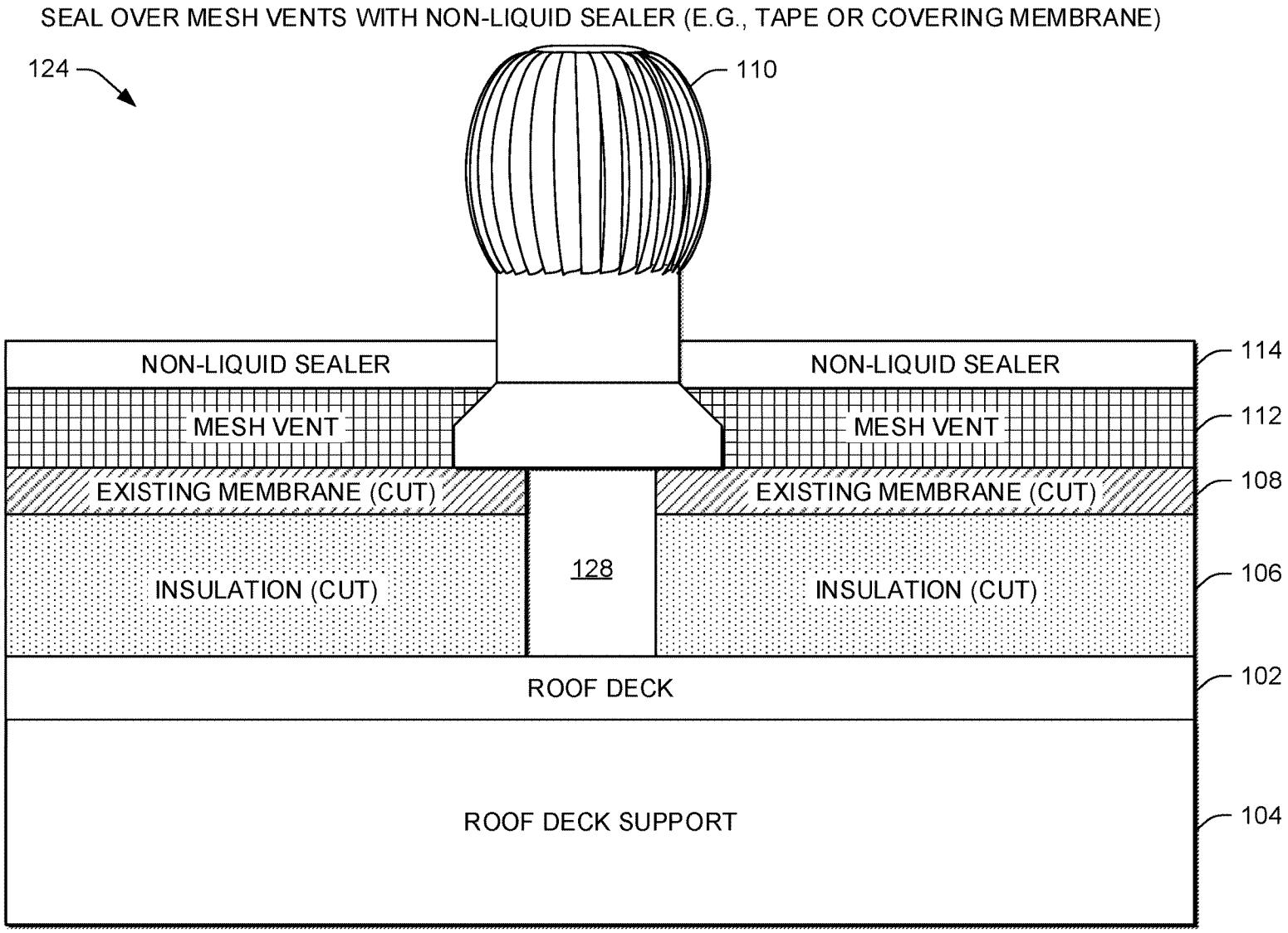
Figure 2E:
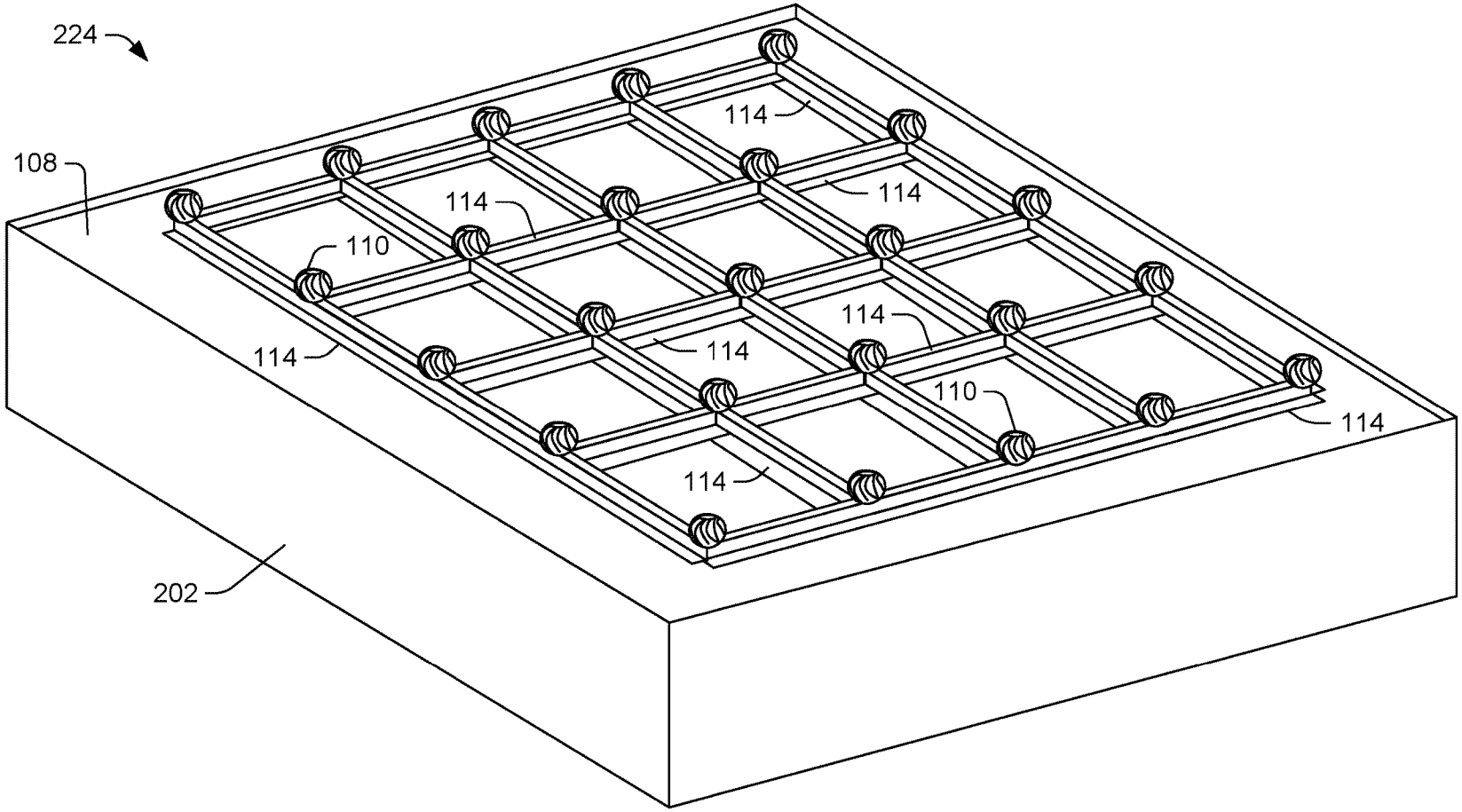

The mesh vent 112 can be sealed off with strips of a non-liquid sealer 114, such as a tape (e.g., adhesive roofing tape) or covering membrane. The cross-section of FIG. 1E shows a view 124 of the cross-section 100 of FIG. 1A after a layer of non-liquid sealer 114 has been installed over the mesh vent 112, sealing it to the existing membrane 108. FIG. 2E shows a corresponding orthographic view 224 after installation of the non-liquid sealer 114 over the strips of mesh vent 112. As examples of a covering membrane, strips of TPO or EPDM, sealed with a silicone mastic, for example, can work as a non-liquid sealer 114. Irrespective of the type of material used for the non-liquid sealer, the non-liquid sealer can completely cover over the strips of mesh vent 112 and overlap onto the existing membrane 108, as shown in view 224 of FIG. 2E. The non-liquid sealer 114 can also seal over the inlet(s) of the mechanical vents 110 in airflow communication with the strips of mesh vent 112, so that the inlets of the mechanical vents 110 remain vent-coupled to the strips of mesh vent 112 and are otherwise sealed off. The non-liquid sealer 114 is thus configured to provide a substantially airtight seal over the strips of mesh vent 112 such that air can only exit the strips of mesh vent 112 via the outlets of the mechanical vents 110.

Figure 1F:
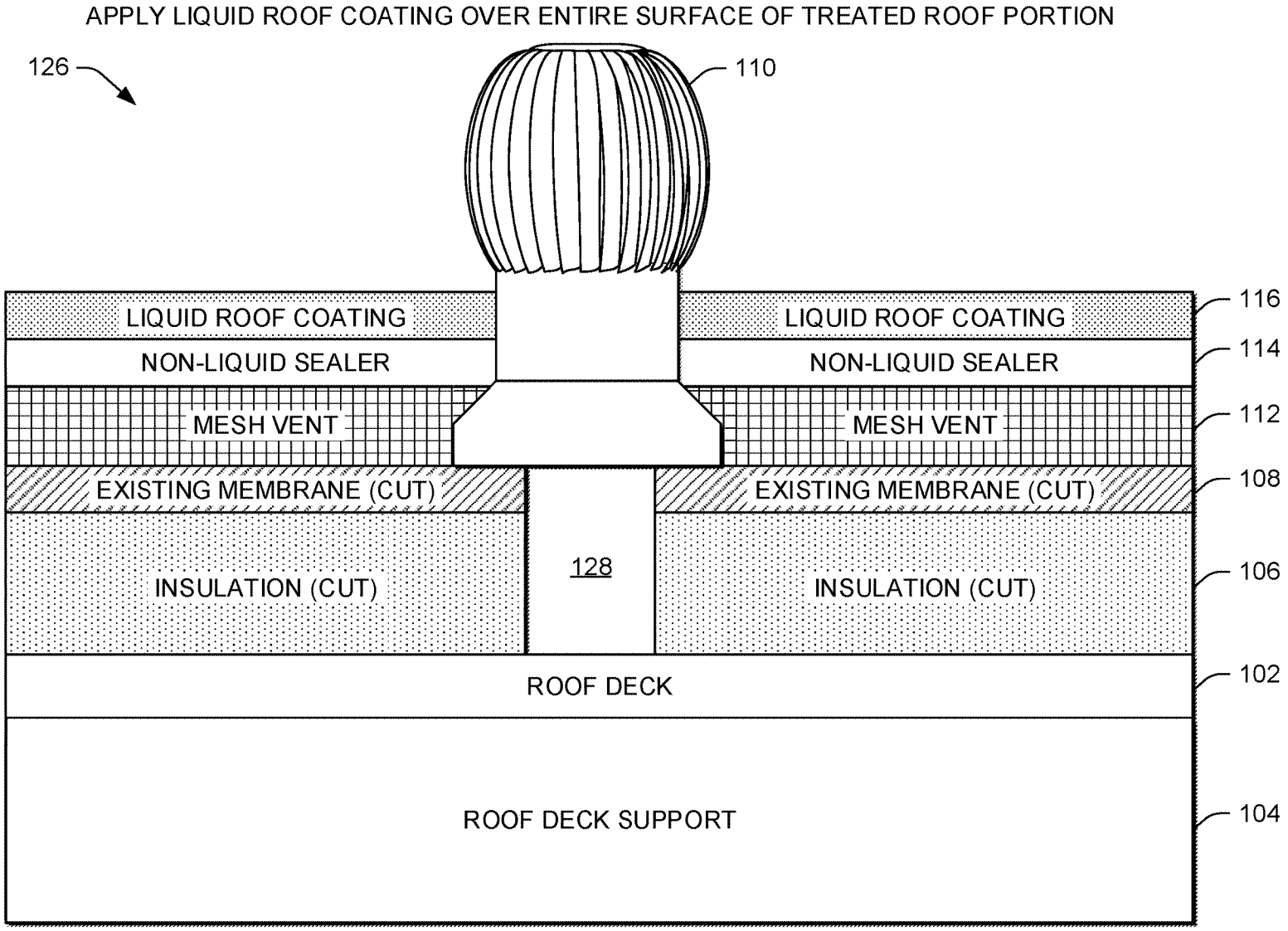
Figure 2F:
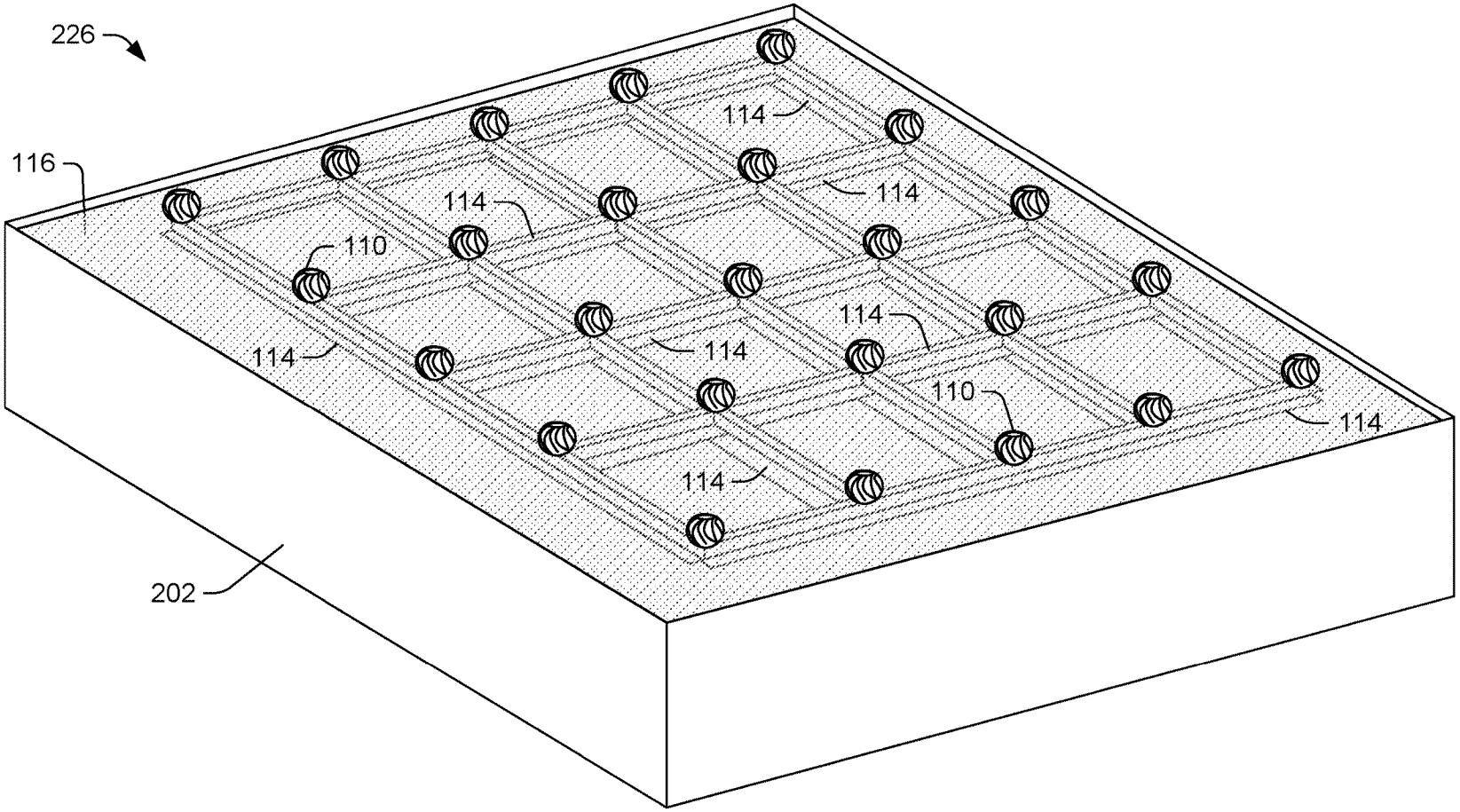
Figure 2G:
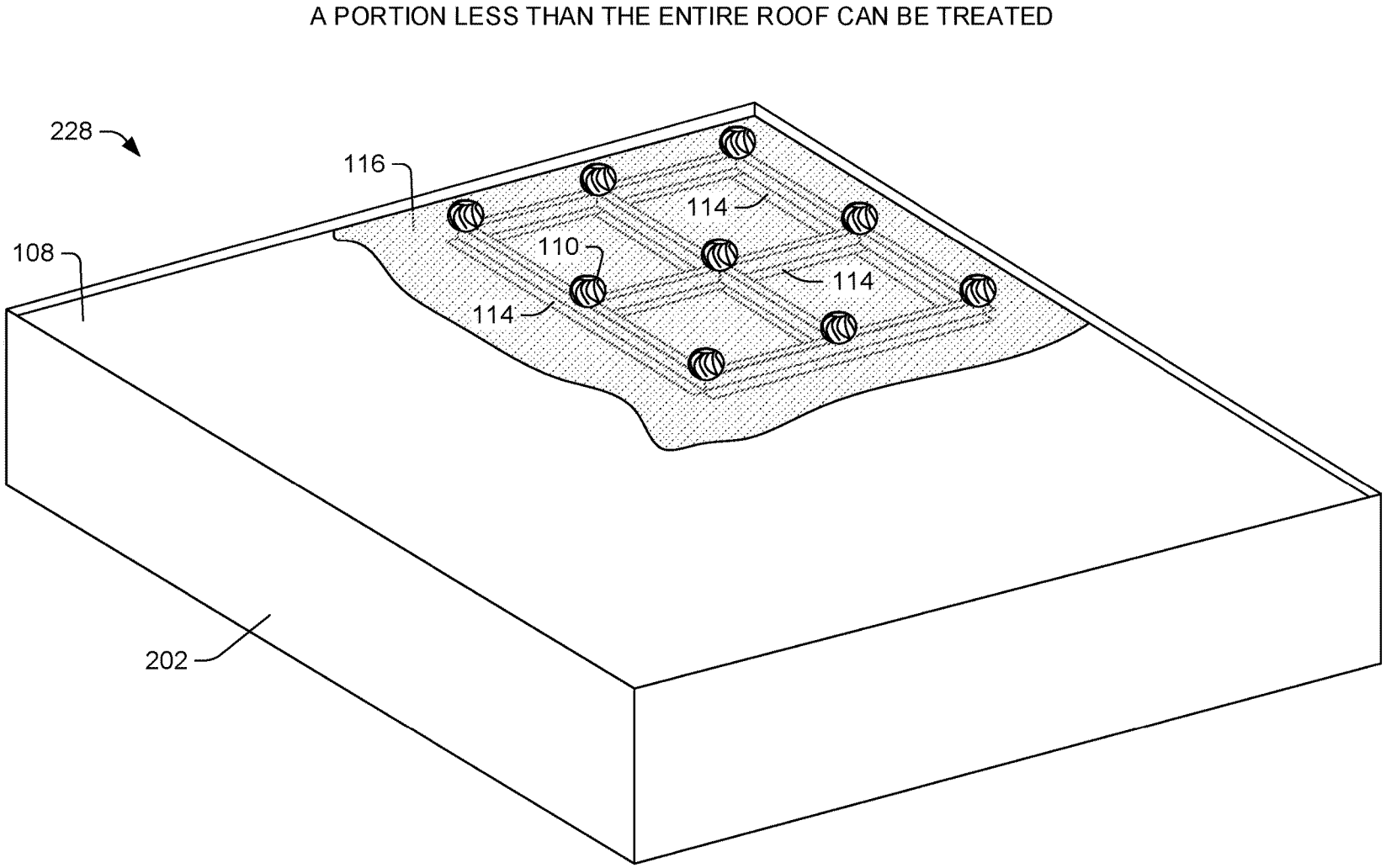

Cross-sectional view 126 of FIG. 1F and orthographic projection view 226 of FIG. 2F show the example roof after a subsequent application of a liquid roof coating 116 over the entire surface of the treated portion of the roof. The liquid applied roof coating 116 can be any used in a liquid applied roof coating system. Example categories of suitable liquid applied roof coatings 116 include silicones, elastomerics, and acrylics. In example view 226, the treated portion of the roof consists of the entire roof of the building 202. Example view 228 of FIG. 2G illustrates that the treated portion can be less than the entire roof. In such examples, the liquid applied roof coating 116 need not be laid down over the entire roof. In any case, the liquid applied roof coating 116 can cover over and completely seal off the strips of mesh vent 112 and their interfaces with the mechanical vents 110, to the extent these are not already sealed by the non-liquid sealer 114. In all examples, the liquid applied roof coating 116 does not cover respective outlets of all of the mechanical vents 110 installed as part of the roof-on-roof leak remediation treatment described herein. Thus, the phrases "a liquid applied roof coating over an entire surface of a treated portion of the roof" and "a liquid applied roof coating over a treated portion of the roof" should not be construed as including liquid applied roof coating over mechanical vent outlets.

Figure 1G:
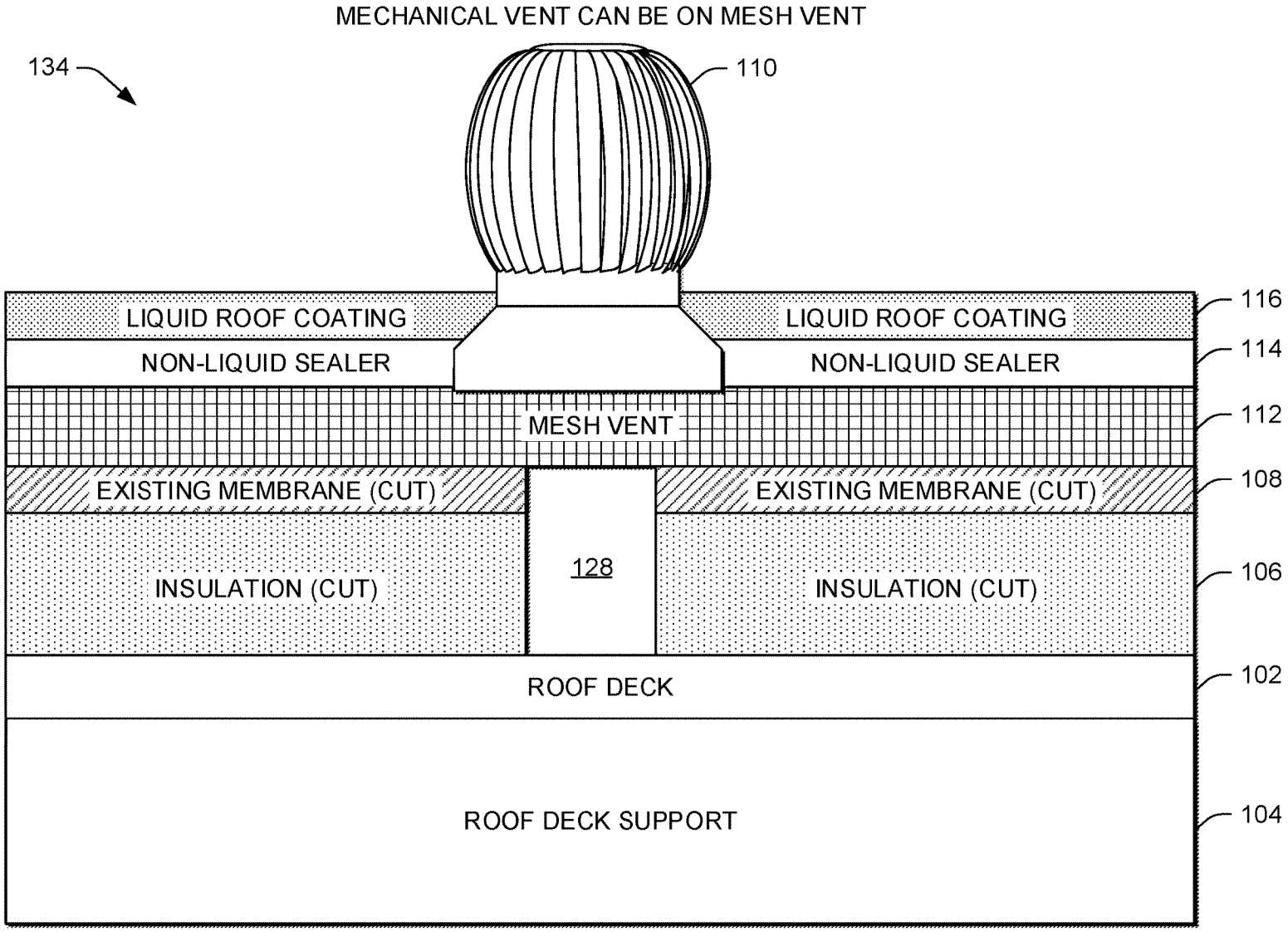

In some examples, as illustrated in cross-sectional view 134 of FIG. 1G, the mechanical vent 110 can be installed over the mesh vent 112 and can be either secured thereto or secured to a lower layer by appropriate fastening. Installing the mechanical vent 110 directly over the existing membrane 108 may have the advantage, in some circumstances, of providing the mechanical vent 110 with a more secure and/or more level hold. Wind-driven turbine vents can require level installation for proper operation. Installing the mechanical vent 110 directly over the mesh vent 112 can have the advantage of simpler installation, because longer strips of mesh vent can be laid down uninterrupted by mechanical vents 110 and because the mechanical vents 110 are not required to have laterally facing inlets. Whereas in the example of view 126 of FIG. 1F, the mesh vent 112 is installed subsequent to the installation of the mechanical vent 110, the mechanical vent 110 is installed on the membrane, and the mesh vent 112 is in airflow communication with a lateral inlet (not shown) of the mechanical vent 110, in the example view 134 of FIG. 1G, the mechanical vent is installed subsequent to the installation of the strip of mesh vent, the mechanical vent is installed on the strip of mesh vent, and the mesh vent is in airflow communication with an underside inlet (not shown) of the mechanical vent 110.

The installation of the layers and structure(s) described above result in a repaired roof system that remediates saturated roofing material by drying. Mechanical vents create negative pressure in the cuts 128 and the mesh vent 112 between the roof deck 102, on the lower side, and, on the upper side, the non-liquid sealer 114 and the liquid applied roof coating 116. The negative pressure results in airflow through the cuts 128 and mesh vent 112 and out through the mechanical vents 110. The airflow is capable of drying out saturated roofing material (e.g., insulation 106) over time, thus ameliorating and ultimately eliminating leaks. The roof remediation is accomplished without costly removal of the existing membrane 108 and saturated roofing material (e.g., insulation 106) and advantageously can be performed on one or more roof portions less than the entire roof.

Figure 3:
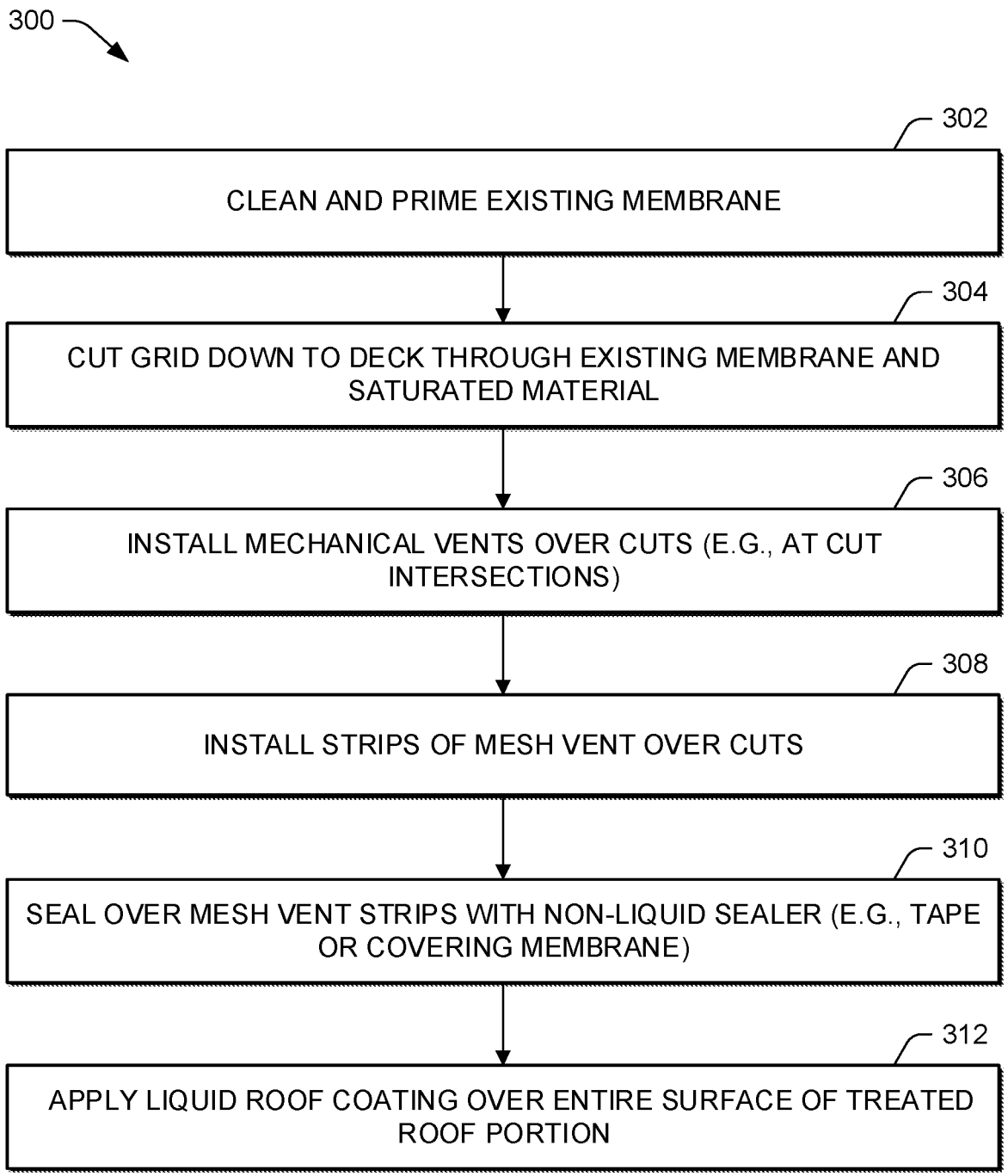
FIGS. 3 and 4 are flow diagrams illustrating example methods of roof-on-roof repair.

FIG. 3 is a flow chart of an example method 300 of roof-on-roof repair. An existing roof membrane can be cleaned and primed 302 over a portion (or portions) of the roof to be treated with the remainder of the method 300. The portion(s) to be treated can be less than the entire roof. The existing membrane can be, for example, as described above with regard to membrane 108 in FIGS. 1A and 2A. After primer cure, a grid can be cut 304 down to the deck through the existing membrane and saturated roofing material. The saturated roofing material can be, for example, as described above with regard to insulation 106 in FIG. 1A. Each cut of the grid can be as described above with regard to cut 128 in FIG. 1B. The cut grid can be as described above with regard to cut grid 128 in FIG. 2B. For example, each cut can be between about 1/16th of an inch and about 1.5 inches in width. The cut depth can be determined by core sampling prior to cutting 304. One or more mechanical vents can be installed 306 over the cuts. The one or more mechanical vents can be, for example, as described above with regard to vent 110 shown in FIGS. 1C and 2C. For example, one or more of the one or more vents can be installed 306 over intersections of multiple cuts. A core cut can be made at a cut intersection prior to installation 306 of a vent over the intersection.

Method 300 of FIG. 3 can continue with strips of mesh vent being installed 308 over the cuts of the grid. The strips of mesh vent can be as described above with regard to mesh vent 112 in FIGS. 1D and 2D. The strips of mesh vent can, in some examples, completely cover the cuts, except where interrupted by already installed mechanical vents. The strips of mesh vent can then be sealed over 310 with non-liquid sealer. The non-liquid sealer can be as described above with regard to non-liquid sealer 114 in FIGS. 1E and 2E. As examples, the non-liquid sealer can be tape (e.g., adhesive roofing tape) or pieces of TPO or EPDM membrane. A liquid roof coating can then be applied 312 over the entire surface of the treated roof portion, including over the sealed mesh vents. The liquid roof coating can be as described above with regard to liquid roof coating 116 in FIGS. 1F, 2F, and 2G. The liquid roof coating can be, as examples, a silicone, an elastomeric, or an acrylic.

Figure 4:
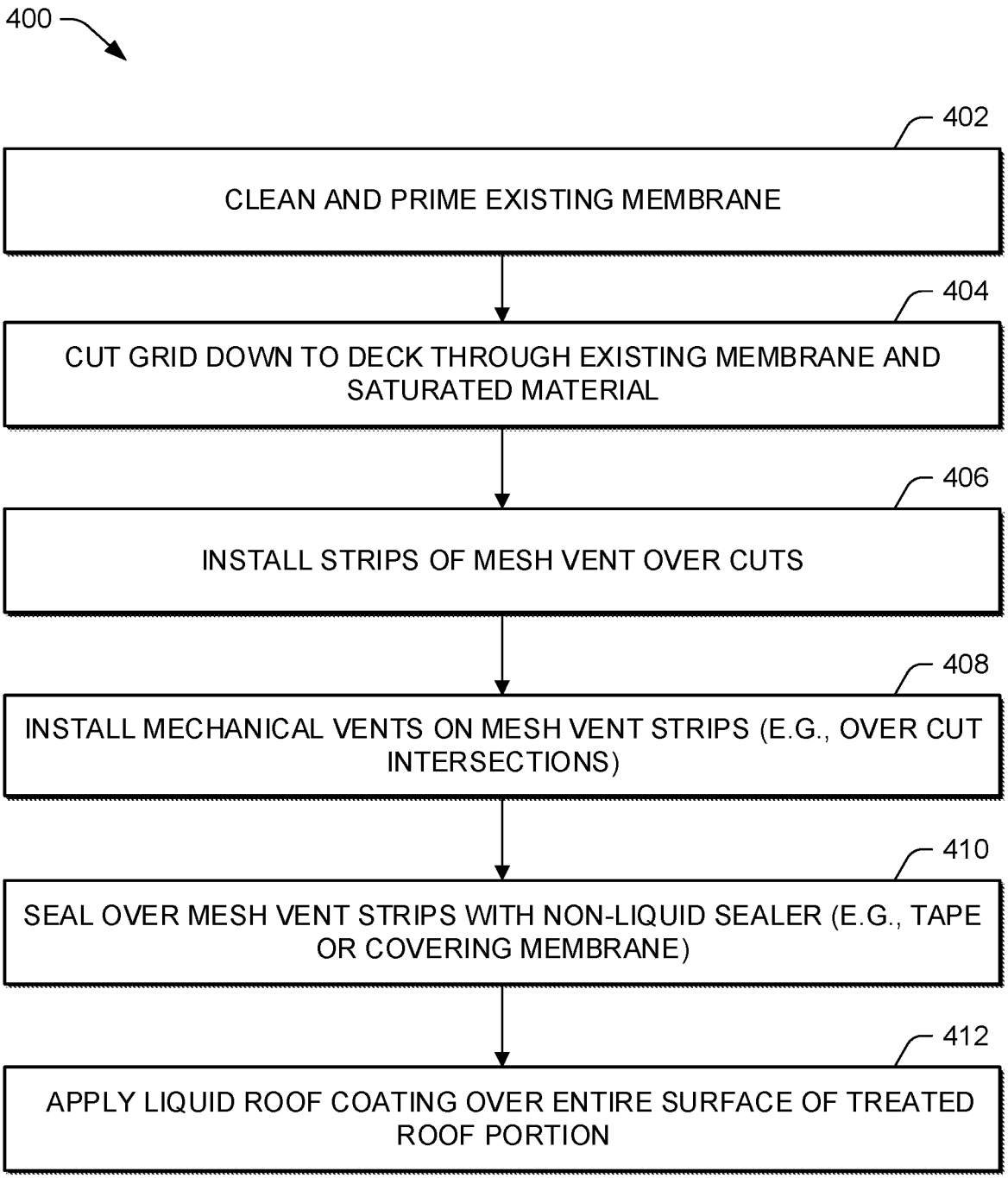

FIG. 4 is a flow chart of another example method 400 of roof-on-roof repair. As with method 300, an existing roof membrane can be cleaned and primed 402 over a portion (or portions) of the roof to be treated with the remainder of the method 400. The portion(s) to be treated can be less than the entire roof. The existing membrane can be, for example, as described above with regard to membrane 108 in FIGS. 1A and 2A. After primer cure, a grid can be cut 404 down to the deck through the existing membrane and saturated roofing material. The saturated roofing material can be, for example, as described above with regard to insulation 106 in FIG. 1A. Each cut of the grid can be as described above with regard to cut 128 in FIG. 1B. The cut grid can be as described above with regard to cut grid 128 in FIG. 2B. For example, each cut can be between about 1/16th of an inch and about 1.5 inches in width. The cut depth can be determined by core sampling prior to cutting 404.

Method 400 of FIG. 4 can continue with strips of mesh vent being installed 406 over the cuts of the grid. The strips of mesh vent can be as described above with regard to mesh vent 112 in FIGS. 1D and 2D. The strips of mesh vent can, in some examples, completely cover the cuts. One or more mechanical vents can then be installed 408 on the mesh vents. The one or more mechanical vents can be, for example, as described above with regard to vent 110 shown in FIGS. 1G and 2C, FIG. 1G showing the mechanical vent 110 installed on the mesh vent 112. For example, one or more of the one or more vents can be installed 408 over intersections of multiple cuts. A core cut can be made at a cut intersection prior to installation 408 of a vent over the intersection. The strips of mesh vent can then be sealed over 410 with non-liquid sealer. The non-liquid sealer can be as described above with regard to non-liquid sealer 114 in FIGS. 1G and 2E. As examples, the non-liquid sealer can be tape (e.g., adhesive roofing tape) or pieces of TPO or EPDM membrane. A liquid roof coating can then be applied 412 over the entire surface of the treated roof portion, including over the sealed mesh vents. The liquid roof coating can be as described above with regard to liquid roof coating 116 in FIGS. 1F, 2F, and 2G. The liquid roof coating can be, as examples, a silicone, an elastomeric, or an acrylic. The liquid roof coating can be, for example, one used in a liquid applied roof coating system having a 5-year or greater warranty.

In some examples, method 300 or 400 can be preceded by selecting one or more portions of a roof to repair using the roof-on-roof repair method as shown in FIG. 3 or 4. The portion selection can be informed by performing core sampling and/or by using thermal imaging to determine roof area portions where roofing material (e.g., insulation) is saturated. The subsequent treatment using the method can then be limited to the selected one or more roof portions.

Methods 300 and 400 of roof-on-roof repair result in a repaired roof system that remediates saturated roofing material by drying. Negative pressure between a roof deck and a liquid applied roof coating as created by the cuts, mechanical vents, and sealed-off mesh vent strips results in airflow through the cuts and mesh vent strips and out through the mechanical vents. The airflow is capable of drying out saturated roofing material (e.g., insulation) over time, thus ameliorating and ultimately eliminating leaks. The roof remediation is accomplished without costly removal of an existing membrane and saturated roofing material (e.g., insulation) and advantageously can be performed on one or more roof portions less than the entire roof. Methods 300 and 400 can also be incorporated in respective methods of drying out saturated roofing material, e.g., without removal of an existing roof membrane.

In an example, a method of roof leak remediation comprises: cutting a grid of cuts through a membrane of a roof, through saturated material of the roof under the membrane, and to a deck of the roof; installing a mechanical vent over a cut of the grid; installing a strip of mesh vent over a cut of the grid, the strip of mesh vent in airflow communication with an inlet of the mechanical vent; sealing over the strip of mesh vent with non-liquid sealer; and applying a liquid roof coating over a treated portion of the roof, including over the non-liquid sealer.

In another example, a method of roof leak remediation comprises cutting a grid of cuts through a membrane above a roof deck and through saturated material of the roof under the membrane; installing strips of mesh vent over cuts of the grid; installing mechanical vents over cuts of the grid; and sealing over the strips of mesh vent with non-liquid sealer.

Other examples include the methods of any of the above examples, wherein the mechanical vent, or at least one of the mechanical vents, is installed over an intersection of two or more cuts of the grid of cuts.

Other examples include the methods of any of the above examples, wherein (a) the installing the strip(s) of mesh vent is subsequent to the installing the mechanical vent(s); the mechanical vent(s) is/are installed on the membrane; and the strip(s) of mesh vent is/are installed to be in airflow communication with a lateral inlet (or respective lateral inlets) of the mechanical vent(s), or alternatively, (b) the installing the mechanical vent(s) is/are subsequent to the installing the strip(s) of mesh vent; the mechanical vent(s) is/are installed on the strip(s) of mesh vent; and the strip(s) of mesh vent is installed to be in airflow communication with an underside inlet (or respective underside inlets) of the mechanical vent(s).

Other examples include the methods of any of the above examples, wherein parallel cuts of the grid of cuts are spaced apart from each other by no more than ten feet.

Other examples include the methods of any of the above examples, wherein no cut of the grid of cuts is closer than five feet to an outer perimeter of the roof.

Other examples include the methods of any of the above examples, further comprising cutting a core cut at one or more intersections of cuts in the grid of cuts.

Other examples include the methods of any of the above examples, wherein the mechanical vent (or at least one of the mechanical vents) is selected from the group comprising a wind-driven turbine vent, an electrically driven vent, or a solar-powered electrically driven vent.

Other examples include the methods of any of the above examples, wherein the non-liquid sealer comprises adhesive roofing tape or pieces of thermoplastic polyolefin (TPO) or ethylene propylene diene monomer (EPDM) membrane.

Other examples include the methods of any of the above examples, wherein the width of a cut of the grid of cuts is between 1/16th of an inch and 1.5 inches.

In still another example, a leak-remediated roof comprises: a solid roof deck; a layer of saturated material over the roof deck; a membrane over the layer of saturated material having one or more failures allowing liquid to engage the saturated material; a grid of cuts extending through the membrane and the saturated material down to the roof deck; a mechanical vent over at least one cut of the grid; a strip of mesh vent over at least one cut of the grid, the strip of mesh vent in airflow communication with an underside inlet or a lateral inlet of the mechanical vent; a non-liquid sealer sealing over the strip of mesh vent; and a liquid applied roof coating over a treated portion of the roof, the treated portion of the roof including the non-liquid sealer.

Other examples include any of the above example leak-remediated roofs, wherein the mechanical vent is installed over an intersection of two or more cuts of the grid of cuts.

Other examples include any of the above example leak-remediated roofs, wherein (a) the mechanical vent is on the membrane and the strip of mesh vent is in airflow communication with a lateral inlet of the mechanical vent; or, alternatively, (b) the mechanical vent is installed on the strip of mesh vent and the strip of mesh vent is in airflow communication with an underside inlet of the mechanical vent.

Other examples include any of the above example leak-remediated roofs, wherein parallel cuts of the grid of cuts are spaced apart from each other by no more than ten feet.

Other examples include any of the above example leak-remediated roofs, wherein no cut of the grid of cuts is closer than five feet to an outer perimeter of the roof.

Other examples include any of the above example leak-remediated roofs, further comprising core cuts at one or more intersections of cuts in the grid of cuts.

Other examples include any of the above example leak-remediated roofs, wherein the mechanical vent is selected from the group comprising a wind-driven turbine vent, an electrically driven vent, or a solar-powered electrically driven vent.

Other examples include any of the above example leak-remediated roofs, wherein the non-liquid sealer comprises adhesive roofing tape or pieces of thermoplastic polyolefin (TPO) or ethylene propylene diene monomer (EPDM) membrane.

Other examples include any of the above example leak-remediated roofs, wherein the width of a cut of the grid of cuts is between 1/16th of an inch and 1.5 inches.

"Grid" as used in this description and the appended claims means grid, lattice, network, matrix, or mesh. Modifications are possible in the described examples, and other examples are possible within the scope of the claims.

What is claimed is:

1. A method of roof leak remediation comprising:
- cutting a grid of cuts through a membrane of a roof, through saturated material of the roof under the membrane, and to a deck of the roof;
- installing a mechanical vent over a cut of the grid of cuts;
- installing a vent strip over a cut of the grid of cuts, the vent strip in airflow communication with an inlet of the mechanical vent;
- sealing over the vent strip with non-liquid sealer; and
- applying a liquid roof coating over a treated portion of the roof, including over the non-liquid sealer.

2. The method of claim 1, wherein the mechanical vent is installed over an intersection of two or more cuts of the grid of cuts.

3. The method of claim 1, wherein:
- the installing the vent strip is subsequent to the installing the mechanical vent;
- the mechanical vent is installed on the membrane; and
- the vent strip is installed to be in airflow communication with a lateral inlet of the mechanical vent.

4. The method of claim 1, wherein:
- the installing the mechanical vent is subsequent to the installing the vent strip;
- the mechanical vent is installed on the vent strip; and
- the vent strip is installed to be in airflow communication with an underside inlet of the mechanical vent.

5. The method of claim 1, wherein parallel cuts of the grid of cuts are spaced apart from each other by no more than about ten feet.

6. The method of claim 1, wherein no cut of the grid of cuts is closer than five feet to an outer perimeter of the roof.

7. The method of claim 1, further comprising cutting a core cut at one or more intersections of cuts in the grid of cuts.

8. The method of claim 1, wherein the mechanical vent is a wind-driven turbine vent.

9. The method of claim 1, wherein the mechanical vent is an electrically driven vent or a solar-powered electrically driven vent.

10. The method of claim 1, wherein the vent strip is a strip of mesh vent.

11. The method of claim 1, wherein the non-liquid sealer comprises adhesive roofing tape or pieces of thermoplastic polyolefin (TPO) or ethylene propylene diene monomer (EPDM) membrane.

12. A method of roof leak remediation comprising:
- cutting a grid of cuts through a membrane above a roof deck and through saturated material of the roof under the membrane;
- installing vent strips over cuts of the grid;
- installing mechanical vents over cuts of the grid; and
- sealing over the vent strips with non-liquid sealer.

13. The method of claim 12, wherein at least one of the mechanical vents is installed over an intersection of two or more cuts of the grid of cuts.

14. The method of claim 13, wherein parallel cuts of the grid of cuts are spaced apart from each other by no more than about ten feet.

15. The method of claim 14, wherein no cut of the grid of cuts is closer than five feet to an outer perimeter of the roof.

16. The method of claim 13, further comprising cutting a core cut at one or more intersections of cuts in the grid of cuts.

17. The method of claim 12, wherein at least one of the mechanical vents is a wind-driven turbine vent.

18. The method of claim 12, wherein the non-liquid sealer comprises adhesive roofing tape or pieces of thermoplastic polyolefin (TPO) or ethylene propylene diene monomer (EPDM) membrane.

19. A leak-remediated roof comprising:
- a solid roof deck;
- a layer of saturated material over the roof deck;
- a membrane over the layer of saturated material having one or more failures allowing liquid to engage the saturated material;
- a grid of cuts extending through the membrane and the saturated material down to the roof deck;
- a mechanical vent over at least one cut of the grid of cuts;
- a vent strip over at least one cut of the grid of cuts, the vent strip in airflow communication with an underside inlet or a lateral inlet of the mechanical vent;
- a non-liquid sealer sealing over the vent strip; and
- a liquid applied roof coating over a treated portion of the roof, the treated portion of the roof including the non-liquid sealer.

20. The roof of claim 19, wherein the mechanical vent is over an intersection of two or more cuts of the grid of cuts.

* * * * *